US005527368A

United States Patent [19]

Supkis et al.

[11] Patent Number: 5,527,368

[45] Date of Patent: Jun. 18, 1996

[54] COATED ABRASIVES WITH RAPIDLY CURABLE ADHESIVES

[75] Inventors: Stanley J. Supkis, Sand Lake; Eugene Zador, Clifton Park; Sitaramaiah Ravipati, Colonie; Richard A. Romano, Watervliet, all of N.Y.; Walter A. Yarbrough, Stormstown, Pa.

[73] Assignee: Norton Company, Worcester, Mass.

[21] Appl. No.: 355,229

[22] Filed: May 17, 1989

Related U.S. Application Data

[63] Continuation of Ser. No. 735,029, May 17, 1985, abandoned, which is a continuation-in-part of Ser. No. 680,619, Dec. 9, 1984, abandoned, which is a continuation-in-part of Ser. No. 474,377, Mar. 11, 1983, abandoned.

[51] Int. Cl.[6] ..... B24D 3/02

[52] U.S. Cl. ..... 51/298; 51/295

[58] Field of Search ..... 51/298, 295

[56] References Cited

U.S. PATENT DOCUMENTS

| | | | |
|---|---|---|---|
| 3,732,647 | 5/1973 | Stith | 51/54 |
| 3,844,916 | 10/1974 | Gaske | 204/159.16 |
| 4,047,903 | 9/1977 | Hesse et al. | 51/298 |
| 4,222,835 | 9/1980 | Dixon | 204/159 |
| 4,320,599 | 3/1982 | Hill et al. | 51/58 |
| 4,389,433 | 6/1983 | Pampalone | 427/341 |
| 4,391,947 | 7/1983 | Sassano | 525/30 |
| 4,457,766 | 7/1984 | Caul | 51/298 |
| 4,485,226 | 11/1984 | Noll et al. | 528/45 |
| 4,773,920 | 9/1988 | Chasman et al. | 51/295 |

FOREIGN PATENT DOCUMENTS

| | | | |
|---|---|---|---|
| 50-141332 | 11/1975 | Japan | B24D 3/28 |
| 119491 | 10/1978 | Japan . | |
| 2087263 | 10/1981 | United Kingdom . | |

*Primary Examiner*—Deborah Jones

[57] ABSTRACT

A coated abrasive having improved properties of grinding performance and brittleness, said abrasive comprising a backing and an abrasive coating adhered thereon wherein the abrasive coating comprises a suspension containing lapping size abrasive grains and a binder, said binder containing a diacrylated monomer and a triacrylated or higher acrylated monomer.

33 Claims, 1 Drawing Sheet

COATED ABRASIVES WITH RAPIDLY CURABLE ADHESIVES

CROSS REFERENCE TO RELATED APPLICATIONS

This application is a continuation of application Ser. No. 735,029, filed May, 17, 1985, now abandoned, which is a continuation-in-part of application Ser. No. 680,619 filed Dec. 9, 1984 and now abandoned, which was a continuation-in-part of Ser. No. 477,377 filed Mar. 11, 1983 and now abandoned.

BACKGROUND OF THE INVENTION

1. Field of the Invention

This invention relates to the provision of coated abrasives which provide a novel combination of high productivity with economy and rapidity of manufacture. In the prior art, the vast majority of coated abrasives have been made with adhesives of animal glue or of synthetic resins, usually thermosetting resins such as urea-formaldehyde or phenol-formaldehyde. Animal glue has a rapid gelling quality which permits the rapid manufacture of coated abrasives which utilize it as the only adhesive, but the grinding or finishing performance of the coated abrasives made with it is not usually as good as of those made with thermosetting resin adhesives. The latter, however, often require several hours of cure before reaching their ultimate strength. This curing time requirement slows the manufacture of the products.

In one of its embodiments, this invention relates particularly to coated abrasive products adapted to the operations of lens fining. This is an established term of ophthalmic art. Further descriptions of the the fining process and of suitable machinery for accomplishing it are readily available in prior patents, e.g., U.S. Pat. Nos. 4,320,599 to Hill et al. and 3,732,647 to Stith, the entire specifications of which patents are hereby incorporated herein by reference. The particular field of this embodiment of the present invention is the provision of an advantageous type of lapping tool such as is shown as item L of the drawings of the Stith patent. The lapping surface 78 of FIG. 2 of the Stith patent may be provided, as has been known, by a suitable coated abrasive material consisting of abrasive grains adhered to a flexible backing, which in turn is supported by the structure of the lap L in Stith FIG. 2.

In another of its embodiments, this invention relates to coated abrasives particularly suited to crankshaft lapping in the manufacture of engines. In still another embodiment, this invention relates to coated abrasives especially suited to the finishing of primer coats and other synthetic surface coatings used for final surface finishing of articles of manufacture made of metal, particularly automobile bodies.

This invention in most of its embodiments also relates to the field of adhesives curable by exposure to ultraviolet (hereinafter UV) light.

2. Description of the Prior Art

The use of adhesives capable of rapid cure under the influence of actinic radiation, particularly UV light, has provided attractive combinations of manufacturing speed and adhesive quality in many coating operations, including a wide variety of decorative surface coating, in which relatively thin and transparent adhesive coatings are adequate. Nevertheless, the use of UV cured coating materials for coated abrasives has been very limited. It appears to have been generally believed that the relatively thick layers of adhesives typically required for coated abrasives would be very difficult or impossible to cure with UV light, because of the limited depth of penetration of such light into most appropriate adhesive formulations. Therefore, most of the workers in the field are believed to have concentrated instead on electron beam curing, as exemplified by U. K. Patent Application 2,087,263, published 26 May 1982. Electron beam curing, while effective, requires significantly greater capital investment than curing with UV light and presents a more serious potential hazard to personnel.

The only published instance of a coated abrasive prepared by UV curing known to us is Japanese Laid-Open Application No. 119491/1978, dated 18 Oct. 1978. This document indicated that the presence of an isocyanate compound in the adhesive is important for success with UV light initiated cure of adhesives for coated abrasives. Furthermore, although it was generally asserted in this Japanese publication that all the formulations disclosed therein are suitable for cure by UV light as well as electron beam curing, only one of the sixteen specific examples actually used UV light, and the adhesive used for this example contained no triacrylated monomers and only a little diacrylated monomer, with the bulk of the adhesive being non-acrylic types of polymerizable unsaturated esters and styrene. The main goal of the art described in this publication appeared to be the use of lower than normal energy electron beams and relatively inexpensive adhesives.

Both the above Japanese reference and a more general teaching by Dixon in U.S. Pat. No. 4,222,835, not referring specifically to coated abrasives, have taught some advantages of using thermal initiators in adhesive formulations intended for radiation-initiated cure.

A waterproof paper coated abrasive with fast curing adhesives was disclosed in U.S. Pat. No. 4,047,903 to Hesse et al., but this product was cured by electron beam radiation only.

U.S. Pat. Nos. 3,844,916, 3,914,165, and 3,925,349 to Gaske teach the use of adducts of acrylates with dibutyl amine and diethyl amine in adhesive formulations suitable for UV light initiated cure generally. These references teach nothing explicitly related to coated abrasives and advance, as the principal advantage of using the amine adducts, counteracting the normal inhibitory effect of atmospheric oxygen on the cure.

U.S. Pat. Nos. 4,391,947 to Sassano and 4,414,367 to Gardner teach various curable coating and molding compositions which include esters of iso-phthalic acid. These compositions are different from those disclosed herein, particularly because of the presence of substantial amounts of styrene or similar copolymerizable monomers, and the Sassano and Gardner references do not teach or suggest any utility of their compositions for coated abrasives.

SUMMARY OF THE INVENTION

It has been discovered that UV light curable adhesives with compositions within specific ranges are capable of providing a wide variety of coated abrasives with grinding performance levels essentially equivalent to or better than those of coated abrasives with conventional thermosetting resin adhesives. Styrene and most non-acrylic unsaturated polyesters, as used in Japanese Laid-Open Application No. 119491/1978, have not been found desirable as components of adhesives for our purposes, because their presence in the adhesives usually has led to inferior coated abrasive performance. Instead, adhesives consisting primarily of particular acrylated monomers, acrylated oligomers, amine adducts of acrylated monomers or oligomers, and particular unsaturated polyesters of iso-phthalic acid have been found to give superior results. Specific details are given below.

One particular type of coated abrasive to be described in this application has been found to have especially advantageous properties for the fining of acrylic plastic ophthalmic lenses. In addition to adhesives within the general range of composition to be described herein, this product for lens fining is characterized by the use of high purity aluminum oxide abrasive grain having adequate transmission for UV Light and by the avoidance or minimization of non-polymerizable solvents. These embodiments of the invention are also characterized by a surface micro-roughness within the range of 1.2 to 6 microns arithmetic average (hereinafter AA) in the cured product.

Types of coated abrasives especially suitable for crankshaft lapping and for the finishing of primers, enamels, paints, and similar protective coatings for metals are also described as specific embodiments of the invention herein.

DESCRIPTION OF THE PREFERRED EMBODIMENTS

Adhesive Components

Acrylated Monomers

Figure 1:
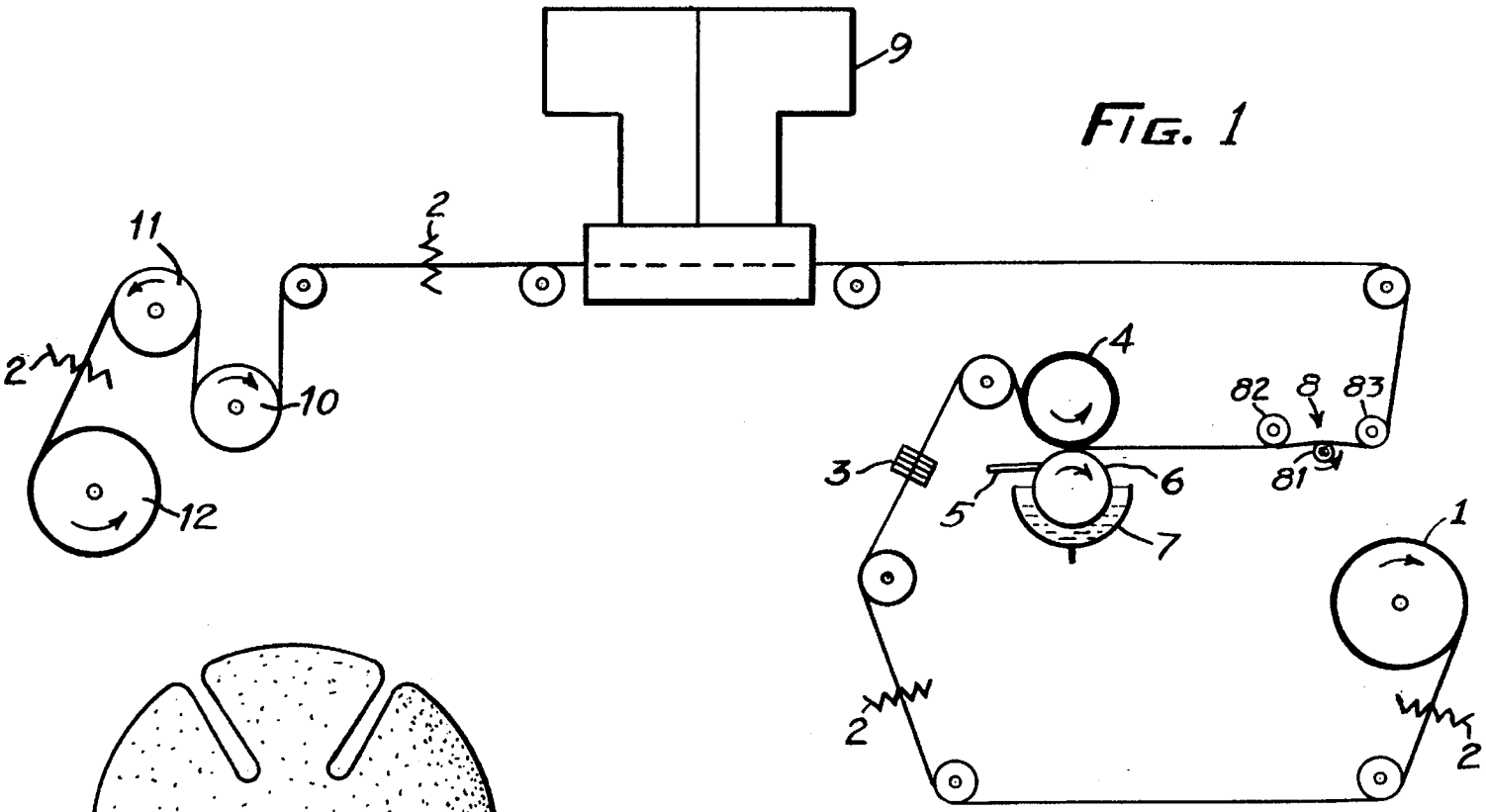
FIG. 1 illustrates a typical process line for continuous production of coated abrasives according to this invention.

For most coated abrasive products except the most flexible ones, the most important polymerizable components of the adhesive used for the products according to this invention are the materials generally known commercially as acrylate monomers. We refer to these materials, which are di-, tri-, or higher poly-alcohols that have usually been acrylated to the maximum extent practical, as acrylated monomers for consistency with our other terminology. (it may be noted that both our term and the more common commercial one are chemically correct, because these materials are acrylates and are produced by acrylating alcohols.) Typical commercial products of this class are trimethylolpropane triacrylate (hereinafter TMPTA) and pentaerythritol triacrylate (hereinafter PETA).

In order to achieve satisfactory coated abrasive products for lens fining applications according to our invention, it is necessary, and for most other types of coated abrasives according to our invention, it is preferable, to use substantial amounts of triacrylated monomers. TMPTA is usually preferred as a triacrylated monomer for the practice of this invention, primarily because it is reported to be least likely of all the commercially available triacrylated monomers to cause allergic skin reactions. If a relatively hard cured product is needed, however, PETA is preferred it is believed that PETA may be better for hard cured products because it may contain significant amounts of tetraacrylated monomers. This is possible because pentaerythritol, unlike trimethyolpropane, has four hydroxy groups. Some commercial products labelled PETA are reported to have average ester numbers as high as 3.4, and such products would be preferred when hardness in the cured product is desired.

For certain purposes, particular the sizer adhesives of coated abrasives with separate sizer and making adhesives, still harder product cures than can be readily obtained with workable amounts of even PETA are needed. These can be achieved by using appropriate amounts of acrylated monomers with four or more acrylate groups per molecule. These are designated collectively herein as "higher acrylated monomers". Among these materials, of which relatively few are known to be commercially available, dipentaerythritol hydroxy pentaacrylate (hereinafter DPHPA) is preferred.

Adhesives in which all the acrylated monomers have three or more acrylate groups often produce very brittle cured products. It is therefore desirable for most products to use some diacrylated monomers in the adhesive. Typical commercially available examples of diacrylated monomers are 1,6-hexanediol diacrylate (hereinafter HDODA), tetraethylene glycol diacrylate, and tripropylene glycol diacrylate. The relative amounts of diacrylated monomers and triacrylated monomers is adjusted along with variations in other components of the adhesive mixture to give suitable viscosity for coating as well as effective grinding and/or finishing characteristics to the coated abrasive ultimately made with the adhesive. For most purposes of this invention, a mixture of HDODA and TMPTA in a weight ratio of from 0 to 0.83 is preferred, with ratios from 0.50 to 0.83 most preferred.

Significant amounts of monoacrylated monomers such as ethyl acrylate and methyl methacrylate or of vinyl substituted aromatics such as styrene are not normally desirable in the adhesives because they can retard cure rates and yield cured products which are more brittle than is desirable for fast-cutting coated abrasives.

For all types of acrylated monomers, unsubstituted acrylates are preferred but substituted ones such as methacrylates could be used. The average molecular weight per acrylate unit of suitable monomers varies from 95 to 160, with 95–115 preferred.

Acrylated Oligomers

For adjustment of the theology of the adhesive before cure and of the toughness and cutting characteristics of the cured coated abrasive products, it is often advantageous to use acrylated oligomers in addition to the acrylated monomers noted above. The "oligomer" part of the term "acrylated oligomer" refers not to oligomers of acrylates, but rather oligomers of other monomers which yield oligomers bearing hydroxyl or other functional groups suitable for reaction with acrylic acid or anhydride. The generally preferred acrylated oligomers are (1) the diacrylates of epoxy resins of the bisphenol-A type (2) di- to octo-acrylates of novolak phenolic resins prepared by the condensation of bisphenol-A or other similar diphenols with formaldehyde, and (3) diacrylates of ester-linked urethane oligomers, as described generally by H. C. Miller, "Acrylcurethane Resin Design" 11 (2) *Radiation Curing* 4–9 (May 1984). Acrylated oligomers are readily available commercially under such tradenames as Celrad from Celanese, Uvithane from Thiokol Corporation, Uvimer from Polychrome, Inc., Purelast from Polymer Systems Corporation, etc. Preferred oligomers have average molecular weights per acrylate unit of 250 to 900, with a range of 270–400 most preferred. Small amounts of higher and lower oligomers, characteristically present in all practical products of this type, have no known harmful effect. Oligomers terminating with unsubstituted acrylate groups are preferred, but methacrylates or other substituted acrylate groups could also be used.

Amines and Amine Adducts

In the prior art, tertiary organic amines have often been added to acrylate adhesive formulations to promote adhesion to particular surfaces. Some of these amines, if unsaturated, are also suitable to serve as viscosity reducers. N-vinyl pyrrolidone (hereinafter NVP) is a suitable unsaturated tertiary amine and is often preferred for the products of our invention.

For many types of coated abrasive products such as waterproof coated abrasive paper for conventional general applications of such a product and for film backed coated abrasives for crankshaft lapping, primary or secondary amine adducts with acrylates were found to be a particularly preferred adhesive component. The adducts were made by reacting acrylates which were otherwise suitable as constituents of the adhesive with the amines. The reactions were not investigated in detail but are believed to follow the path known as the Michael reaction:

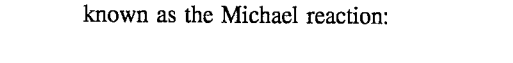

$$R_aR_bNH+R_cOOCCH{=}CH_2{=}R_cOOCCH(NR_aR_b)CH_3,$$

where $R_a$ can be hydrogen, or $R_a$ and $R_b$ together can be a ring or other fused structure, as in morpholine, piperidine, etc.

A variety of adducts were prepared and utilized in adhesive formulations suitable products according to our invention. Butyl, hexyl, octyl, 2-ethylhexyl, lauryl, and ethanol primary amines and methylethanol and diethanol secondary amines were all adducted with TMPTA, as were morpholine and a commercial mixed ether amine, Adogen 188, available from Sherex Chemical Co., Inc. Dublin, Ohio. This latter product has the formula $R_dO(CH_2)_3NH_2$, with the $R_d$ moiety representing a mixture of $C_8$ to $C_{10}$ alkyl groups. Adducts of some of these same amines were also made with pentaerythritol triacrylate and with the commercial acrylated epoxy oligomer Celrad 3700 as described in more detail in the Examples below.

The choice of an amine adduct depends on balancing its various effects on viscosity, compatibility (i.e., avoidance of phase separations) with the other desired constituents of the adhesive mixture, and value for aiding the dispersion of abrasive grain in the adhesive when desired. One of the advantages of amine adducts generally is that they may have substantially lower viscosity than the acrylate used to make them, particularly if the latter is an oligomer. Adducts of secondary amines are especially low in viscosity. Thus the adducts with TMPTA of all the primary amines listed above except lauryl had viscosities between 1000–2500 centipoises (cp). The lauryl amine adduct with TMPTA had a viscosity of 600 cp, while the adducts of the same acrylated monomer with the three secondary amines listed above had viscosities between 200–300 cp.

Many particular adducts are likely to be acceptable in most formulations. An often preferred adduct resulted from the reaction of octyl amine and TMPTA, and the preparation and use of this product will be described as exemplary of the techniques which could be followed to prepare any other of the adducts noted, with variations in conditions of preparation as known conventionally to those skilled in organic reactions.

To make the octyl amine/TMPTA adduct, one half mole of the amine was added slowly to one mole of the TMPTA containing 0.2 gm of phenothiazine as an oxidation inhibitor in a vessel provided with a reflux condenser. The reaction mixture was maintained at a maximum temperature of 49° C., with ninety minutes after complete addition of the amine allowed for additional reaction. Because of the relative quantities, the reaction indicated above can not be complete for all the acrylate component, but the entire product (designated hereinafter as OAA) was treated as the adduct for purposes of the mass ratios shown in adhesive formulations in the specific Examples herein. In specifying the amount of adduct in other contexts herein, however, including the appended claims, only the amine(s) and the stoichiometrically equivalent amount of acrylate, assuming reaction of one hydrogen atom per amine group, is counted as adduct mass.

In general it was found that at least up to one quarter of the total of all acrylated monmers and oligomers specified in any adhesive formulation herein could be replaced by an amine adduct of the particular type of acrylated monomer or oligomer to be substituted by its amine adduct, and the appended claims should be interpreted as providing for this substitution if desired.

Unsaturated Polyesters

Carefully selected unsaturated polyester resins, when present in the adhesive formulations to no greater extent by weight than acrylated monomers, are valuable in obtaining cured products which combine fairly high hardness with high toughness, so that coated abrasives using such cured products as adhesives resist shedding by brittle fracture of the adhesive. This combination of properties is desirable in almost all coated abrasives and it particularly important in products for crankshaft lapping, in which the coated abrasive is backed with a rigid curved support, preventing any significant accommodation of mechanical stress by temporary deflection of the abrasive itself.

Satisfactory unsaturated polyesters for this purpose were found to include the reaction products of (a) a linear terminal diacid, or its anhydride, bearing vinylic unsaturation, such as maleic acid, and (b) iso-phthalic acid, with (c) linear terminal diols such as dipropylene glycol. While such resins are commercially available, they are normally so available only in mixtures with substantial amounts of styrene, and such mixtures should not be used for this invention, because the styrene has two very deleterious effects: cure rates are reduced, and the brittleness of the products is increased. Thus the preferred unsaturated polyester resin for our use, designated UPR hereinafter, was made by reacting maleic anhydride, iso-phthalic acid, and dipropylene glycol in the mole ratios of 2:1:3 at 215° C. for 8–10 hrs with removal of water as it was formed by distillation. Phenothiazine in an amount about 0.02% by weight of the other ingredients was added to the reaction mixture as an oxidation inhibitor. The resulting polyester had an average molecular weight of about 1000, had an acid number of 32–35, and was a solid with a melting point of about 85° C. (Acid number is defined as the milligrams of potassium hydroxide required to neutralize 100 grams of the polyester.)

Thermoplastic Polymers and Plasticizers

Preferred formulations often but not always include some thermoplastic polymer in the adhesive composition. The reason for a beneficial effect from the presence of such materials is not known, but it may be connected with reduction of brittleness or of stresses induced by shrinkage of the adhesives upon cure. Various thermoplastic rubbers, polymethylmethacrylate, and cellulose esters and their derivatives are suitable, with cellulose acetate butryate preferred. The particular type most preferred is CAB-381-0.5 from Eastman Kodak, which is characterized by having (1) butyrate for about 38% of the total ester groups, with the remainder acetate; (2) one hydroxyl group for each four anhydroglucose units; and (3) a falling ball viscosity of about 0.5 seconds when viscosity determined by ASTM Method D-1343 in the solution described as Formula A in ASTM Method D-871 and converted from poises to seconds by the calculation described in ASTM Method D-871.

Thermoplastic polymers often impart high viscosity to the formulations, so that their use must often be restricted for that reason. To some extent, this generally undesirable viscosity building effect can be offset by converting some of the acrylated monomers and/or oligomers which would otherwise be used to amine adducts.

An alternative and often equally satisfactory type of component to achieve the same general benefits as thermoplastic polymers is a plasticizer of the type commonly used for many simple plastics. Di(2-ethylhexyl) phthalate and dipropylene glycol dibenzoate are typical examples of suitable plasticizers. A critical distinction between these often desirable constituents and the undesirable solvents described above for viscosity reduction is volatility. Suitable plasticizers are liquids with less than one mm of mercury vapor pressure at room temperature. Because the plasticizers can often serve additionally as solvolytic agents, thermoplastic polymers and plasticizers can often be combined in the formulations advantageously, as shown in some of the Examples below.

Photoinitiators

If cure of the adhesives is to be initiated by UV light as is normally preferred, the adhesive composition, must contain a conventional photoinitiator which will adequately absorb and transfer to the acrylate components the energy from the lamps used to initiate cure. Methods for determining the amounts and types of photoinitiator used are conventional in the art of UV cured surface coatings, and the same methods were found effective for purposes of the present invention. The amount of photoinitiator is generally from 0.5 to 7.0% by weight of the amount of adhesive used.

One photoinitiator preferred for some embodiments of this invention was 2,2-diethoxyacetophenone (hereinafter DEAP). This initiator is convenient because it is a liquid and therefore easily mixed into the adhesives. Another photoinitiator preferred for other embodiments was 2,2-dimethoxy-2-phenyl acetophenone (hereinafter DMPA). However, 2-chlorothioxanthone, benzophenone, and 1-hydroxycyclohexyl phenyl ketone, may also be used, along with many others.

Thermal Initiators

With certain adhesive formulations, or with extensive coverage of the coated abrasive product with grain which strongly absorbs UV light, a cure initiated by UV light was found to be fully effective only in the outer part of the adhesive layer. In such situations, an additive capable of generating free radicals with heat was found to be a useful addition to the adhesive formulation. The cure of acrylates is strongly exothermic, so that cure of even the outer part of an adhesive layer can generate enough heat to initiate cure of the remainder of the layer with the help of such a thermal initiator. If the amount of heat generated by the UV lamp and by the reaction of that part of the adhesive which is adequately cured under the influence of UV light is not sufficient to cure the remainder of the adhesive layer, outside heating sources such as an oven or infrared lamp may effectively be used. Numerous well known peroxides, hydroperoxides, and azo compounds can serve this purpose, but 2,2'-azobis(2-methylbutyronitrile), hereinafter designated as AMB, was found to be preferable because of its relative stability at room temperature and low toxicity.

The properties of the products were found to depend on the ratio of thermal to photoinitiators used in the adhesive formulations. For the preferred general purpose photoinitiator, DEAP, and the preferred general purpose thermal initiator, AMB, a ratio of 3:1 by weight was preferred.

Adhesion Promoters

A normally preferred component in the adhesive formulations is a material, sometimes referred to as a "coupling agent", which improves the bonding between the adhesive and the abrasive grain. These materials are sometime referred to as "coupling agents". Most organosilanes and organotitanates containing at least one organic group with from 10–20 carbon atoms have this property. An often preferred material, especially for products to be used for lens fining, was tetrakis[(2,2-diallyloxymethyl)- 1-butoxy] titanium di(tridecyl) monoacid phosphite (hereinafter OTI). Another suitable material, preferred for adhesives containing unsaturated polyesters, is an oligomer of tetrabutyltitanate, available under the designation "butyl polytitanate" from Kay-Fries, Inc., Stony Point, N.Y. and designated herein as TBTP.

Viscosity Reducers

In the prior art, it has often been common to dilute radiation curable adhesive components with inert solvents to reduce viscosity. Such a practice is disfavored for practice of the present invention, because it generally leads to poor adhesion of the cured coating to the backing. If dilution is necessary to reduce the viscosity to a level acceptable for processing, only materials, sometimes referred to as "reactive diluents". containing vinyl unsaturation and capable of copolymerizing with the primary acrylate adhesive components should normally be used. Vinyl acetate is a typical example of a suitable viscosity reducer Small amounts of nonpolymerizing solvents such as toluene, benzene, methylene chloride, etc. are acceptable when needed for viscosity reduction, but should generally be kept to less than 1% by weight of the total adhesive to be used.

Activators

Materials known as activators, which have a synergistic effect with photoinitiators, are well-known in the general art of UV curable coatings. These materials, which are generally amines, make it possible to reduce the amount of generally more expensive photoinitiator while still achieving adequate cure. Such materials may optionally be used in the adhesive formulations of the present invention, but are generally not preferred, except to the extent that the amine constituents already noted as components preferred for other purposes may serve also as activators.

Colorants

Dyes or pigments may be used if desired to color the products. However, if UV light is to be used for cure, care must be taken to select colorants which will not unduly absorb the light and thus interfere with the cure.

Fillers

As with conventional coated abrasives, in many cases it is both economical and advantageous to the product performance to use a finely ground solid filler in the adhesive composition. For purposes of this invention, the UV light absorption of the filler must be considered along with other characteristics considered for normal coated abrasive products. Silica or calcium sulfate filler is preferred, but other fillers with adequate UV transmission could also be used.

Other Product Components

Abrasive Grain

In general, abrasive grains similar to those used on conventional types of conventional coated abrasives are preferred for the same applications. However, in the embodiments of this invention particularly adapted to second fining of lenses, white aluminum oxide is preferred even though brown aluminum oxide or some other abrasive such as silicon carbide might be preferred for coated abrasives made with normal adhesives. This is true because brown aluminum oxide, zirconia-alumina abrasive, silicon carbide, and most other conventional chemical types of abrasive grain, except for white aluminum oxide and the softer and thus generally less effective silica, are strong absorbers of UV light For second fining, typical satisfactory commercial abrasive grain products are Types 38 or 1690 Alundum in an average twelve micron grade available from Norton Company, Worcester, Mass., and Grit F800 Alodur WSK from Treibacher USA, Inc., New York City.

Backings

A very wide variety of backing materials may be used for products according to the present invention. This includes backings which are conventional for coated abrasives generally, such as suitably finished cloth, paper, and vulcanized fiber, along with other less conventional backings such as films of polyethylene terephthalate, polyvinyl chloride, aluminum, etc.

For the particular embodiments of this invention especially suited for lens fining, it is necessary that the backing should be waterproof, since the product is normally used wet; that the strength of the backing should be sufficient to resist tearing or other damage in use; that the thickness and smoothness of the backing should allow the achievement of the product thickness and smoothness ranges noted further below; and that the adhesion of the adhesive to the backing should be sufficient to prevent significant shedding of the abrasive/adhesive coating during normal use of the product. These requirements are most readily met by the use of plastic films or waterproof paper as the backing. The most preferred backing is polyethylene terephthalate film with a thickness of about 0.003 inch or 0.075 mm. One advantage of the present invention is that good adhesion to polyethylene terephthalate backing can be achieved without the need for any special primer on the backing However, primed backings may be used for this invention if desired or needed in other cases.

General Processing Characteristics

The adhesive may be applied to the backing by any of the variety of ways generally well known in the coated abrasive art. For example, direct roll coating, transfer roll coating, knife coating, and combinations of these could all be used. The final thickness of separate maker and size layers of adhesive used for manufacturing most general purpose types of coated abrasive should be approximately the same with these adhesives as with conventional ones, so that the thickness of the wet adhesives as applied during manufacture should take appropriate account of the lesser tendency of these adhesives to shrink upon cure than that of conventional adhesives. The intensity and time of exposure of the products to UV light and to any auxiliary heating needed are determined by methods well known in the art of coating with adhesives cured by exposure to UV light, supplemented if necessary by testing of the grinding or other surface finishing performance of the coated abrasives produced. Suitable cure time and conditions for specific examples are given below. Abrasive grains may be applied to the wet adhesive in any conventional manner, usually by electrocoating. For the embodiments of this invention especially adapted to lens fining, however, the grain is slurried with the adhesive, and no size coat is required or desirable.

Special Process and Product Surface Characteristics for Embodiments of This Invention Especially Adapted to Ophthalmic Lens Fining For lens fining, the thickness of coating in itself is not inherently critical, but a combined thickness of the backing and the product has become established as standard in the industry and is relied upon to give the proper lens curvature when used with the backup lapping tool supports which are conventional. This thickness is 3 to 5 mils (=75–100 microns) and should normally be used unless there is a special reason to deviate from it. The uniformity of thickness is inherently critical, because if the thickness of coating varies excessively from one part of the abrasive to another, it is possible for one part of the lens to escape proper polishing, as a result of a low spot on the abrasive, or to be excessively thinned, by a high spot on the abrasive. The combined thickness of backing and adhesive/abrasive over the surface of the portion of coated abrasive used for a single lens should not vary by more than 0.7 mil (=18 microns), when measured with an instrument, such as a conventional micrometer, which measures the thickness of local high spots on the coating over an area of at least 0.05 square centimeters.

The thickness measured as described immediately above will average out surface roughness on a scale smaller than about 0.5 mil (=12 microns). Nevertheless, it has been discovered that a certain amount of surface roughness is necessary to promote effective action of the product. Although on a much smaller scale, this may be imagined as the difference between a metal file and a smooth surface of the same metal; the file cuts much more effectively.

The most convenient method for measuring and controlling the required surface roughness is the use of a device designed to measure scratch depth on surfaces. A wide variety of such instruments is available. The one used for most of the work which led to the instant embodiment of the present invention was the Surtronic 3, sold by Rank-Taylor-Hobson of Leicester, England. This instrument, when used as directed on any surface, yields a direct reading of the AA "scratch depth" in microinches, which may easily be converted to other units if desired. All products effective for lens fining were found to have AA readings with this instrument of from 1.2 to 6 microns, with the preferred products falling in the range 2.2 to 3.8 microns. Products with smoother or rougher surfaces gave less than optimal cut and were often susceptible to shedding small portions of the coating during use, thereby endangering the uniformity of fining action on the lens for which they were used.

The required surface roughness is readily generated when adhesive/abrasive slurries of the compositions specified herein are coated on adequately smooth backings by drawing the backings between two polished steel bars maintained at a constant small spacing, while a part of the space is filled with the slurry. The slurry may also be effectively coated with a doctor blade by hand.

A method of coating which has been found suitable to achieve the required thickness uniformity and surface roughness in continuous processing is shown schematically in FIG. 1. The backing to be coated is placed on an unwind stand 1 fitted with a brake which can be adjusted to give a resistance to unwinding corresponding to 90 gms force per centimeter of width of the backing. Lengths 2 of loosely suspended copper tinsel connected to an efficient ground are provided on the coating line to eliminate any dangerous build-up of electrostatic charge. Before entering the coating area, the backing is passed between felt wipers 3 to remove any foreign particles which would endanger the uniformity of the coat.

The coating is applied by a direct gravure roll 6 which has a trihelical pattern with sixty-two lines per inch cut with a number eighty-one tool by Consolidated Engravers. The speed of rotation of this roll is maintained so that the periphery of the roll matches the backing in linear speed. Before contacting the backing, the wetted surface of the gravure roll is wiped with a trailing doctor blade 5. A Benton type A blade constructed of Type 304 stainless steel, 203 microns thick and 5 cm wide, with a blade angle of 97° was found satisfactory when used at an angle of 46° to the web at the point of contact. The blade used was supplied by Input Graphics, Inc. The backing web was supported in the coating nip by a non-driven, freely rotating, rubber-coated backup roll 4. The rubber on this roll had a hardness of Shore A-75. For convenience in maintaining cleanliness of the coating, the backup roll was generally undercut so that a zone about six mm in width on each edge of the backing was not subjected to pressure in the nip and thus was not coated.

Adhesive/abrasive slurry was supplied to the gravure roll from a coating pan 7 which was kept filled to a constant level via a recirculation loop not shown. A pump in the recirculation loop maintained constant agitation of the slurry, so that settling of the denser abrasive component did not occur to any significant extent.

After receiving the wet slurry coating on its lower side, the web passes through a texturing bar assembly 8. The texturing bar proper 81 is a case hardened steel bar about 25 mm in diameter. The bar 81 is driven to rotate opposite to the direction of passage of the backing web at a speed about one-third higher than that of the web. The texturing bar is mounted so as to cause a displacement of the web of about 19 mm from the "natural" path it would otherwise assume; this natural path is defined by the lower surface of the two idler rolls 82 and 83, which contact the uncoated back of the web.

After texturing, the wet backing web is passed under a source 9 of UV light. The radiant power of the source 9, together with the heat input of any additional heat source not shown in the Figure but optionally introduced between the outlet from the UV light source and the takedown rubber covered idler contact roll 10 must be sufficient to cause hardening of the adhesive before the web reaches roll 10. An effective UV light source for the formulations described below in preparation of products for lens fining was provided by Ewe successive Model F440-10 lamp holders fitted with one Type D followed by one Type H lamp bulbs each of the bulbs having a light output of 46 watts per square centimeter. The power supply for each lamp was Type P 140A. All these by light producing components were supplied by Fusion Systems, Inc. of Rockville, Md.

Roll 10, a rubber covered drive roll 11, and compressed air driven takedown 12 together constitute a conventional takedown assembly, which functions to product a wrinkle-free, tightly wound roll of coated abrasive product.

It will be appreciated by these skilled in the art that many variations of all these coating conditions are possible and are included within the scope of the instant invention.

The practice of the instant invention may be further appreciated from the following examples. In these examples, all proportions stated are to be understood as proportions by mass or weight, unless otherwise noted.

EXAMPLE 1

This example describes the preparation of a general purpose waterproof paper coated abrasive according to the present invention. The acrylated oligomer used for the adhesive was Celrad 3700, commercially available from Celanese. This oligomer is a product of acrylating an epoxy resin derived from bisphenol-A and has an average molecular weight per acrylate unit of about 275. The complete formulation of the maker adhesive was:

| | |
|---|---|
| Celrad 3700 | 50 parts |
| OAA, prepared as described above | 40 parts |
| NVP | 10 parts |
| DEAP | 4 parts |
| AMB | 1 part |
| Vinyl acetate | 30 parts |

This adhesive had a viscosity of about 100 cp at 38° C., the coating temperature for this example.

The above formulation was coated to a thickness yielding a coating mass of 9 gm per square meter on conventional C weight coated abrasive waterproof paper. This paper had been previously coated on the same side with 10 gm/m$^2$ of a presize of self reacting vinyl acrylic terpolymer latex, filed with very fine (about 1000 grit) silica. Grit 320 silicon carbide conventional coated abrasive grain was electro-coated into the uncured adhesive to an extent of 47 gm/m$^2$. The adhesive was then cured by exposure to two type H UV lamps with a light output of 135 watts per centimeter of width for a total of 3 seconds, followed by exposure to an infrared radiator with a power level of about 13,500 watts/square meter for 10 seconds.

The composition of the sizing adhesive was:

| | |
|---|---|
| Celrad 3700 | 300 parts |
| TMPTA | 150 parts |
| Calcium sulfate filler | 150 parts |
| NVP | 30 parts |
| DEAP | 19.2 parts |
| AMB | 4.8 parts |
| OTI | 1.2 parts |

This formulation had a viscosity of about 100 cp at the coating temperature of about 38° C. Sufficient sizer adhesive was applied to reduce about the same size height after cure as for a conventional waterproof coated abrasive with an oil modified phenolic resin size. Cure was by the same exposure to light and heat as for curing the maker.

The product prepared as described above was tested in a grinding test laboratory by established procedures and found at least equal in sanding hard and soft auto body primer materials to a conventional grit 320 SiC waterproof paper with an oil modified phenolic resin maker adhesive and a conventional resole phenolic resin size.

EXAMPLE 2

This was like Example 1 except that grit 60 silicon carbide grain was used rather than grit 320; the maker adhesive formulation was modified to increase the amount of DEAP to 5 parts, with other constituents remaining the same as before; coating mass levels were 47 gm/m$^2$ for maker adhesive and 293 gm/m$^2$ for abrasive grain; and 184 gm/m$^2$ of size adhesive were used, so as to approximately match the size height of a conventional grit 60 product. This product gave better results in sanding both hard and soft auto body primer materials than a conventional grit 60 silicon carbide product with the same adhesives as for the conventional product in Example 1.

EXAMPLES 3.1–3.4

These examples illustrate the preparation of a variety of slurry-coated coated abrasive products useful for the fine finishing of surfaces, including particularly semiconductors, ceramics, and refractories. An adhesive masterbatch #3 was prepared for use in all the examples, with the following composition:

| | |
|---|---|
| Celrad 3600 | 1333 parts |
| TMPTA | 1679 parts |
| HDODA | 1392 parts |
| NVP | 1114 parts |
| OTI | 10 parts |
| Zonyl A | 5.5 parts |

In this formulation, Celrad 3600 is a resin with essentially the same chemical characteristics as Celrad 3700 already described except for a lower viscosity, and Zonyl A, supplied by duPont, is a surfactant which aids in wetting the abrasive grain and thereby reduces the viscosity which would otherwise prevail. For each example 553 parts of masterbatch #3, 35 parts of DEAP, and 1104 parts of abrasive grain were mixed prior to coating. The abrasive grain was micropowder industrial diamonds, grade A-1 for Example 3.1, finely ground iron oxide (crocus) for Example 3.2, and 12 micron average size white alumina for Examples 3.3 to 3.5. The backings were unprimed polyethyleneterephthalate for Examples 3.1 and 3.2, unplasticized polyvinylchloride film for Example 3.3, and aluminum foil for Example 3.4. For each example, a coating of the slurry of adhesive and abrasive was spread to a uniform thickness of about 0.9 mil (=0.022 mm) over the surface of the backing. The coated backing was then exposed for 2 seconds to to the output of a mercury vapor UV lamp with radiant power of about 80 watts per centimeter of width. A tightly adherent coating with useful abrasive properties was produced in each example.

EXAMPLES 4.1–4.10

These examples illustrate the ranges of acceptable and preferred proportions of the various acrylate constituents of the abrasive/adhesive slurry used for preparing embodiments of this invention particularly suited to ophthalmic lens fining. Slurries were prepared having the compositions shown in Table 1, with all percentages being by weight. Type 1690 Alundum, shown in Table 1, is a white, high purity, synthetic aluminum oxide abrasive grain, with an average particle size of 12 microns, available from Norton Company as already noted. A grading analysis of this abrasive, performed by the standard sedimentation techniques, showed that 10% of the grain by volume sedimented at rates corresponding to an equivalent spherical particle size of 18 microns or greater; 30% corresponded to 13 microns or greater; 50% corresponded to 11 microns or greater; and 80% corresponded to 8 microns or greater. The other components in the formulas shown in Table 1 have already been identified.

The mixtures described in Table 1 were coated on

TABLE I

ADHESIVE COMPOSITIONS FOR EXAMPLES 4.1 TO 4.10

| | Percentage of Component in Adhesive for Example Number: | | | | | | | | | |
|---|---|---|---|---|---|---|---|---|---|---|
| Adhesive Component | 4.1 | 4.2 | 4.3 | 4.4 | 4.5 | 4.6 | 4.7 | 4.8 | 4.9 | 4.10 |
| TMPTA | 14.2 | 9.9 | 9.5 | 8.1 | 7.1 | 18.1 | 13.6 | 9.1 | 4.5 | 0.0 |
| HDODA | 11.8 | 8.2 | 7.8 | 6.7 | 5.9 | 0.0 | 4.5 | 9.1 | 13.6 | 18.1 |
| Celrad 3600 | 0.0 | 7.9 | 8.7 | 11.1 | 13.0 | 7.9 | 7.9 | 7.9 | 7.9 | 7.9 |
| NVP | 6.6 | 6.6 | 6.6 | 6.6 | 6.6 | 6.6 | 6.6 | 6.6 | 6.6 | 6.6 |
| DEAP | 2.1 | 2.1 | 2.1 | 2.1 | 2.1 | 2.1 | 2.1 | 2.1 | 2.1 | 2.1 |
| Type 1690 Alundum | 65.3 | 65.3 | 65.3 | 65.3 | 65.3 | 65.3 | 65.3 | 65.3 | 65.3 | 65.3 |
| OTI | 0.005% for all Examples | | | | | | | | | |

polyethyleneterephthalate film backings with a thickness of 75 microns, using a laboratory coating device composed of two polished steel cylinders about 5 cm in diameter held with their axes in a horizontal plane and their surfaces 87 microns apart at the nearest point. A sample of the backing was put into the gap, and a portion of the gap defined by side dams within the area covered by the backing was filled with the adhesive/abrasive slurry mixtures. The viscosity of the slurry was sufficient to prevent it from flowing through the gap under the influence of gravity alone. By drawing the backing through by hand at a rate of about one-half meter per second, a uniform coating thickness was deposited on one side of the backing. The coating was cured by exposure to UV radiation such as that specified in the above description of FIG. 1.

Figure 2:
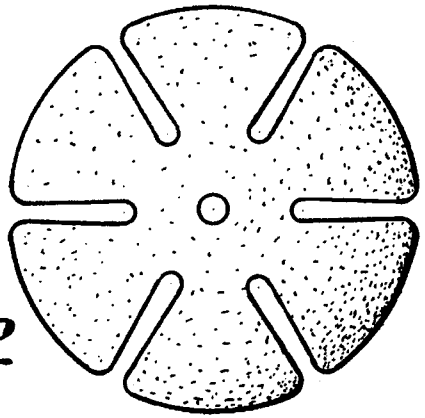
FIG. 2 shown the shape of the typical article, ready for actual use on a machine as described in the Stith patent, of an embodiment of the invention especially suitable for lens fining.

From the coated abrasive webs thereby produced, all of which had surface roughnesses within the acceptable range, sections were die cut in the "snowflake" shape shown in FIG. 2. One of these sections was attached with pressure sensitive adhesive to a lapping tool backup structure properly sized and curved to generate lens surfaces of the curvature required for 6¼ diopter lenses of 10 cm diameter, said lapping tool backup structure being mounted in a lens polishing machine essentially as described in the Stith patent cited above. An acrylic plastic, 6¼ diopter lens blank, previously finished by conventional first fining with grit 600 silicon carbide waterproof paper, was mounted in each of the appropriate positions on the polishing machine, and the pressure urging the coated abrasive lapping tool against the lens blank was adjusted to 9 kg force. The machine was then operated for one minute.

The criteria prescribed for a successful result of this test are (1) removal of at least 0.03 mm from the center of the lens, (2) elimination of all visually detectable scratches left by the first fining process, (3) general uniformity of the lens surface, and (4) lack of appreciable shedding of the coating of the abrasive lapping tool.

The results of the tests of the products made in this example showed that the product from the composition of Example 4.5 was essentially ineffective for second fining, while those from Examples 4.8 to 4.10 were only marginally acceptable. The other compositions were fully satisfactory, with that of Example 4.3 being somewhat less preferable than the others because of a worse shedding tendency. Thus it was concluded that the ratio between diacrylated monomers and triacrylated monomers should lie between 0 and 0.85, and that the ratio between the amount of acrylated oligomer and the total of the acrylated monomers should not exceed 0.5.

Products from Example 4.2 were additionally tested in actual use by comparing them to an established commercial product for second fining of lenses: 12 Micron Aluminum Oxide Imperial Lapping Film, supplied by Minnesota Mining and Manufacturing Co. The products of Example 4.2 were judged at least equal in performance to the commercial product in the second fining of lenses made from polyallyldiglycol carbonate plastic.

EXAMPLES 5.1–5.6

This set of examples was utilized to determine the acceptable ratios between abrasive grain and the adhesive components of the slurry for products to be used for the second fining of plastic lenses. For these examples, the same proportions between all ingredients except the abrasive as prevailed in Example 4.2 were used. The ratio between weight of abrasive the weight of all other constituents except the DEAP was varied as follows: for 5.1, 0.50;, for 5.2, 1.0; for 5.3, 1.7; for 5.4, 2.0; for 5.5, 2.5; and for 5.6, 3.0. The slurry of Example 5.6 was too viscous to coat properly by the methods tried. The other slurries were converted into coated abrasive products in the same manner as described for Examples 4.1–4.10. Example 5.1 produced a product with inadequate cutting ability; Example 5.2 yielded a product which was marginally satisfactory; the products from Examples 5.3 and 5.4 were fully satisfactory; and that from Example 5.5 was marginally satisfactory. From these results it was concluded that the ratio of abrasive to all constituents of the adhesive except the DEAP in products intended for the second fining of lenses should lie between 1 and 2.5.

EXAMPLE 6

For this example, a slurry with the same composition as that for Example 4.2 was prepared. This mixture was mixed for twenty-four hours with a Shar saw-tooth impeller blade (from Shar, Inc. of Fort Wayne, Ind.) rotated at eight hundred revolutions per minute. The slurry thus mixed was charged to the coating pan of a coating line of the type shown schematically in FIG. 1 and coated at a speed of about nine meters per minute on a backing of polyethyleneterephthalate film with a thickness of about 3 mils (=75 microns). Type A Mylar from DuPont was-the film specifically used. A coating about twenty microns in overall thickness was applied and cured as described in the section above entitled *Special Process . . . Characteristics . . . Especially Adapted to . . . Lens Fining*. The cured web from this operation was die cut into shapes as shown in FIG. 2 and tested as described for Examples 4.1 to 4.10. After testing, it was determined that an average of 0.05 mm of thickness from the center of the lens blank had been removed by the polishing action. Also, the other criteria for successful test results as specified under Examples 4.1–4.10 were achieved.

EXAMPLE 7

This was the same as Example 6, except that waterproof paper (specifically Munising Type S-44278 from Kimberly-Clark Corporation) rather than polyethyleneterephthalate film was used as the backing. A product with satisfactory results in the test for second fining of lens described in Example 6 was obtained.

EXAMPLE 8

This Example is the same as Example 4.2, except that the NVP component shown in that Example was omitted; all other components of the slurry in Example 4.2 were used in the same proportion to each other as in Example 4.2. The product prepared by coating this slurry and curing in the same manner as described for Example 4.2 performed satisfactorily in the standard test for lens second fining as described in Example 6. However, when the test conditions were varied by raising the force urging the lens blank against the coated abrasive from 9 kg to 15 kg, the product of this example showed some signs of minor shedding of the coating, while the product of Example 4.2 showed no such signs even under this higher pressure testing. The product of Example 4.2 is therefore preferred to that of this example.

EXAMPLES 9.1–9.5

These examples describe the preparation of a group of products with varying abrasive grain grit sizes, made by a conventional coated abrasive making process to the extent that it comprises a first application of maker adhesive, electrostatic coating of abrasive grain into the wet maker adhesive, curing the maker, sizing the resulting product with a second layer of sizing adhesive over the abrasive grain, and curing the sizer adhesive, to anchor the grain firmly in place. The process was unconventional, however, in that both maker and sizer adhesives were rapidly cured by reactions initiated by UV light. The products described were found particularly useful in tests for crankshaft lapping and for finishing of various types of surface coatings used in automobile manufacturing.

The customary mode of use of crankshaft finishing products requires a back treatment of the coated abrasive with a filled adhesive in order to increase the coefficient of friction to a sufficient value to prevent the coated abrasive from slipping while working. The back treatment is applied before the abrasive grain on the other side from the one which performs the actual work of finishing. The adhesive composition for the back treatment was:

| | |
|---|---|
| Uvithane 782 | 400 parts |
| TMPTA | 460 parts |
| HDODA | 460 parts |
| NVP | 300 parts |
| DEAP | 80 parts |
| Fluorad FC 430 | 30 parts |
| Dipropylene glycol dibenzoate (DPGDB) | 30 parts |
| OTI | 30 parts |
| Finely ground solids | 2,564 parts |

The solids were most preferably grit P400 Type EPL abrasive grain from Treibacher USA, Inc., New York City, but calcium carbonate, silica, or almost any other similarly fine and reasonably uniform particle size solid material which will act as a friction enhancer would be adequate. The figure for parts by weight given above should be adjusted to give the same volume of solids if materials with different densities are used. Uvithane 782 is a diacrylated polyester urethane oligomer with an average molecular weight of about 5500. Fluorad FC 430 is a fluoroaliphatic polymeric ester with nonionic surfactant activity, available from the 3M Company. Other components have been previously identified.

In mixing the adhesive for back coating, the Fluorad was dissolved in the DPGDB in a preliminary step. Other ingredients were mixed in the order listed. The resulting slurry was coated as described above for Example 6, except that the coating thickness was controlled to give an add-on mass of 200±10 gm/m$^2$ (with alumina solids), the coating speed was 12 meters/min, and the backing thickness was 0.13 mm. The preparation of the maker adhesive began by mixing the following ingredients:

| | |
|---|---|
| OOA | 4500 parts |
| NVP | 750 parts |
| CAB 381-0.5 | 300 parts |
| Foamaster VC | 15 parts |

Foamaster VC is a trademark of Diamond Shamrock Chemicals Co., Morristown, N.J. for an antifoam agent of proprietary composition; the other ingredients have already been identified. The ingredients were added one at a time in the order listed, and the mix was stirred at high speed for about 30 minutes after all ingredients had been added. The result was designated Mix A. Mix B was made by dissolving Fluorad FC-430 in an equal amount by weight of DPGDB.

The maker adhesive was then prepared from the following ingredients:

| | |
|---|---|
| Mix A | 6,000 parts |
| DPHPA | 1,000 parts |
| HDODA | 600 parts |
| NVP | 600 parts |
| DMPA | 350 parts |
| Triton X-100 | 35 parts |
| OTI | 30 parts |
| Mix B | 30 parts |
| Foamaster VC | 15 parts |

Triton X-100 is a non-ionic surfactant octylphenol ether available from Rohm & Haas Corp. The ingredients listed were added to a mixer in order and stirred at high speed until thoroughly mixed.

The maker adhesive was then coated on polyethylene terephthalate film by the process described for coating adhesive slurry in Example 6, except that the operating speed was 12 meters/min and no smoothing bar was used. Between the coating station and the bank of lamps used for cure, an electrostatic grain coating apparatus as conventionally used in the coated abrasive industry was introduced and used to apply abrasive grain to the extent noted in the chart below. The products were then illuminated as in Example 6, so that the maker adhesive was cured.

In preparation for sizing, Mix C was prepared as follows: 2 parts by weight each of Uvithane 783, Celrad 3600, and PETA were warmed separately and added while sufficiently warm to flow easily into a mixer initially filled with one part by weight NVP. After thorough mixing, the Mix was allowed to cool to room temperature, where it had a viscosity of about 6,000 cp. The cooled Mix was used to make the sizer adhesive as shown below.

The coated products after maker cure as described above were sized with a sizer adhesive of the following composition:

| | |
|---|---|
| Mix C | 2,500 parts |
| TMPTA | 1,500 parts |
| HDODA | 500 parts |
| DPHPA | 500 parts |
| DPGDB | 300 parts |
| DMPA | 250 parts |
| Triton X-100 | 35 parts |
| OTI | 20 parts |
| Mix B | 20 parts |
| Foamaster VC | 20 parts |
| BYK-073 | 5 parts |
| Silica (about 400 mesh) | 3,000 parts |

BYK-073 is an antifoam agent of proprietary composition, available from Byk-Mallinckrodt USA Inc. Wallingford, Conn.

The sizer adhesive was coated with a two roll vertical padder as is conventional in coated abrasive manufacture, then cured as in Example 6, except at a speed of 6 meters/min. The following chart gives further specifications for the specific products of each sub-part of the Example:

Chart of Maker, Grain, and Sizer Weights

| | Maker | Abrasive Grain | | | Sizer |
|---|---|---|---|---|---|
| Product Ident. | Mass, Gm/m² | Type | Grit Size | Mass, Gm/m² | Mass, Gm/m² |
| 9.1 | 25–34 | Wht | 30 mi | 105–126 | 80–88 |
| 9.2 | 34–42 | FRPL | P320 | 126–147 | 140–154 |
| 9.3 | 42–63 | FRPL | P240 | 185–195 | 180–200 |
| 9.4 | 42–63 | Wht | 60 mi | 185–195 | 180–200 |
| 9.5 | 63–84 | FRPL | P180 | 300–330 | 200–220 |

In this chart, "Wht" indicates the same type of grain as in Examples 4, and sizes noted as a number followed by "mi" indicate a median particle size of the number in microns. FRPL indicates a type of semi-friable light brown aluminum oxide available from Treibacher USA Inc., New York, N.Y., and grit sizes prefixed with P indicate sizing according to the standards of FEPA, a European trade association, as well known in the coated abrasive art.

Products 9.1 and 9.4 were coated on 0.125 mm thick film which had previously been backcoated as described at the beginning of this Example. Products 9.2, 9.3, and 9.5 were coated on 0.075 mm thick film with no backcoating, but the back of these products was later coated with pressure sensitive adhesive and the front (abrasive) side of these products was later coated with a zinc stearate dispersion; both of these subsequent coatings used materials conventionally known in the coated abrasive art and were applied by conventional processes.

Products 9.1 and 9.4 were tested in actual finishing of crankshafts and were found to be equal to or better than similar grain sizes of 3M Imperial Microfinishing Film, a commercial product in actual use for that purpose. The other products of these examples were tested against other commercial coated abrasives with similar grit sizes, grain types, and additional surface coatings in finishing a variety of paints, enamels, primer coats, and similar surface finishing agents in practical use in automobile manufacture, and were generally at least as satisfactory for such finishing as established commercial coated abrasive products.

EXAMPLES 10.1–10.3

This example illustrates the preparation of products adapted to crankshaft lapping as with Examples 9.1 and 9.4, but with a slurry of grain and adhesive as the "maker" coat, so that no sizer coat is needed. The same backcoated backing as for Examples 9.1 and 9.4 was used. The ingredients for the adhesive part of the slurry were as follows in parts by weight:

| | |
|---|---|
| Uvithane 782 or Celrad 3600 | 400 parts |
| TMPTA | 460 parts |
| HDODA | 460 parts |
| NVP | 300 parts |
| DEAP | 80 parts |
| OTI | 3 parts |
| Mix B (from Examples 9) | 6 parts |

Whether Uvithane (U) or Celrad (C) was actually used in a particular case is shown in the chart below.

Chart of Adhesive and Abrasive Types and Masses Used

| Product Identification | Slurry Composition: Adhesive Type | Grain Type and Grit Size | Mass Ratio, Grain:Adhesive | Mass of Slurry Coated, Gm/m$^2$ |
|---|---|---|---|---|
| 10.1 | C | P600 FRPL | 1.7 | 85–90 |
| 10.2 | U | WA500 Fuj | 2.0 | 105–113 |
| 10.3 | C | P500 FRPL | 1.4 | 100–105 |

In the chart above, "FRPL" and grit sizes prefixed with P have the same meaning as in Examples 9. Grit "WA 500 Fuj" grain was a white aluminum oxide obtained from Fujimi Kenmazai Kogyo Co., Ltd., Nagoya, Japan. Grading was reported by the manufacturer as follows: Maximum particle size, 55 microns; 10% greater than or equal to 43 microns; 20% greater than or equal to 38 microns; 50% greater than or equal to 30 microns; greater than or equal to 26 microns; 90% greater than or equal to 23 microns; all greater than or equal to 22 microns. All three products were tested under conditions of actual use in crankshaft lapping against 3M Imperial Micro Finishing Film Aluminum Oxide, Type Q, and were at least equally satisfactory in performance.

EXAMPLE 11

This example illustrates the use of polyesters of isophthalic acid as constituents of the adhesives used to make coated abrasive products according to our invention.

Preliminary Mix D was made by melting 2,900 parts of UPR with 1.5 parts of phenothiazine in a stirred reactor, then adding 2,900 parts of TMPTA and 2,000 parts of HDODA to the melted UPA with stirring until a homogenous mixture was achieved, then cooling the mixture. The maker adhesive had the following composition:

| | |
|---|---|
| Mix D | 210 parts |
| NVP | 30 parts |
| DMPA | 6 parts |
| Benzophenone | 2 parts |
| DC-193 | 1 part |
| Silica (about 400 mesh) | 100 parts |

DC-193 is silicone glycol copolymer surfactant available from Dow Corning Corp., Midland, Mich. These ingredients were mixed in the same fashion as for the maker of Examples 10 and coated as in Example 10.2 with a maker adhesive mass of 40–55 gm/m$^2$ and a mass of 140–185 gm/m$^2$ of grit P280 FRPL abrasive grain as generally described in Examples 10, except that coating was at 3 m/min.

In preparation for sizing, Mix E was prepared by mixing 2 parts Uvithane 783, 3 parts, DPHPA, and 1 part NVP. The sizing adhesive composition was:

| | |
|---|---|
| Mix E | 600 parts |
| TMPTA | 50 parts |
| HDODA | 50 parts |
| NVP | 50 parts |
| DMPA | 30 parts |
| Kay-Fries TBTP | 10 parts |
| DC-193 | 5 parts |
| Silica (about 400 mesh) | 400 parts |

This adhesive was coated as described for sizing in Examples 9 to a level of 150–190 gm/m$^2$ and cured at 3 m/min. The resulting coated abrasive product was tested in a laboratory procedure established to simulate crankshaft finishing, and was found slightly superior in performance to 40 micron 3M imperial Lapping Film, which is believed to be in common commercial use for such finishing.

EXAMPLE 12

This example illustrates the preparation of an amine adduct of an acrylated oligomer and the use of such an adduct to make products suitable for lens fining.

For preparation of the adduct, 1,320 parts of Celrad 3700, 170 parts of DPGDB, and 0.4 parts of phenothiazine were charged to a reaction vessel fitted with addition ports and a reflux condenser. The vessel was heated to 51° C. and stirring commenced. A mixture of 40 parts methyl ethanol amine, 108 parts di(isobutyl) amine, and 10 parts toluene was added to the reaction vessel slowly enough so as to keep the temperature below 55° C., and after all the amine mixture had been added, an additional hour of reaction at 54° C. was allowed, after which 400 parts of TMPTA was added. The resulting mixture was designated Mix F.

Example 6 was then repeated, except that Mix F was substituted for the Celrad 3600 constituent in the adhesive. The resulting product tested at least as well in all respects as the product made in Example 6.

Product Preferences

From the above examples and others, we have determined the preferred adhesive compositions noted below for coated abrasive products generally and for the three specific embodiments of our inventions suitable for lens fining, crankshaft lapping, and finishing of surface coatings for metals.

General Purpose Products

Whether the product has a single adhesive layer into which the abrasive grain is slurried before coating or has separate making and sizing adhesives, the components of the liquid part of an adhesive to be cured by UV light should consist of at least three-fifths by weight of materials selected from the group consisting of triacrylated monomers, higher acrylated monomers, diacrylated monomers, acrylated oligomers, organic amine adducts of triacrylated monomers, and organic amine adducts of diacrylated monomers. As already indicated, if flexible products are desired, amine adducts, diacrylated monomers, and acrylated oligomers with relatively long chains between the acrylate groups should make up the bulk of the adhesive. When harder, more abrasion resistant products are desired and more product stiffness can be tolerated, the triacrylated monomers and higher acrylated monomers should be favored in the formulation. When either economy or greater stiffness is desired, filler contents up to about forty percent by volume may advantageously be added.

It is generally preferable, especially for ease of processing and for moderate flexibility in the end product, that at least one fifth by weight of the materials specified above should be amine adducts of triacrylated or higher acrylated monomers. It is more preferable that the amines should be selected from the group consisting of (a) primary alkyl amines in which the alkyl group has from four to twelve carbon atoms and may be straight or branched; (b) alkyl ether primary amines having a chemical formula of the form $CH_3(CH_2)_xO(CH_2)_yNH_2$ with x ranging from five to ten and y from one to four; (c) hydroxyalkyl primary amines with from one to four carbon atoms per molecule; (d) alkyl and hydroxyalkyl secondary amines with a total of three to ten carbon atoms per molecule; and (e) penta- and hexa-cyclic secondary amines. If the backing for the coated abrasive product is waterproof paper, it is most preferable that the amine be octyl amine and the acrylate TMPTA, while if the backing is polyethylene terephthalate film, adducts of octyl amine, 2-ethylhexyl amine, and morpholine with TMPTA are equally highly preferable.

Crankshaft Lapping and Surface Finish Sanding Products

Products for these applications can be made satisfactorily by at least two different methods: single slurry adhesive coat, or separate maker, electrostatic grain coating, and sizing adhesive coat. For products to be made by the single coat process, it is preferred that the liquid part of the adhesive comprises (a) from 21 to 27 percent by weight of diacrylated oligomers; (b) from 24 to 30 percent by weight of triacrylated monomers; (c) from 24 to 30 percent by weight of diacrylated monomers; and (d) from 15 to 20 percent by weight of N-vinyl pyrrolidone.

When separate maker and sizing adhesives are used, the maker may comprise any formulation within the range given above for general purpose products. Preferably, the maker should contain at least three-fourths by weight of materials selected from the group consisting of (i) triacrylated monomers, (ii) diacrylated monomers, (iii) acrylated oligomers, (iv) polycoesters of (I) iso-phthalic acid, (II) a linear vinylically unsaturated dicarboxylic acid or its anhydride, and (III) a diol, (v) organic amine adducts of triacrylated monomers, (vi) organic amine adducts of diacrylated monomers, and (vii) mixtures thereof. More preferably, the maker adhesive liquid should comprise (a) from 25 to 40 percent by weight of (i) amine adducts of triacrylated monomers, (ii) polycoesters of (i) iso-phthalic acid, (II) a linear vinylically unsaturated dicarboxylic acid or its anhydride, and (III) a diol, (iii) thermoplastic polymers, (iv) plasticizers, or (v) mixtures thereof; (b) from 25 to 40 percent by weight of triacrylated monomers, higher acrylated monomers, or mixtures thereof; and (c) from 5 to 25 percent by weight of diacrylated monomers. In general the items in group (a) of this list provide some product flexibility and, perhaps more importantly, shock resistance, while the proportions between groups (b) and (c) control the overall flexibility and aggressiveness of the product.

For crankshaft lapping, the maker adhesive most preferably comprises (a) from 30 to 37 percent by weight of (i) amine adducts of triacrylated monomers, (ii) polycoesters of (I) iso-phthalic acid, (II) a linear vinylically unsaturated dicarboxylic acid or its anhydride, and (III) a diol, (iii) thermoplastic polymers, (iv) plasticizers, or (v) mixtures thereof; (b) from 29 to 33 percent by weight of triacrylated monomers, higher acrylated monomers, or mixtures therof; and (c) from 25 to 35 percent by weight of diacrylated monomers, N-vinyl pyrrolidone, or mixtures thereof.

For either application within this group, it is preferable for the sizing adhesive to be harder and stiffer than the maker adhesive, so that the product will cut more aggressively, without being excessively brittle overall. A highly preferred composition range for the sizing adhesive is (a) from 22 to 28 percent by weight of a diacrylated oligomer; (b) from 6 to 39 percent by weight of triacrylated monomers; (c) from 38 to 8 percent by weight of higher acrylated monomers; (d) from 5 to 10 percent by weight of diacrylated monomers; and (e) from 20 to 10 percent by weight of N-vinyl pyrrolidone, plasticizers, or mixtures thereof. As indicated by the order of the numerical ranges above, triacrylated monomers and higher acrylated monomers should be adjusted complementarily, so that using more of one leads to less use of the other.

For the finishing of metal surface coating materials such as primer, enamel, etc., it is highly preferred that the coated abrasives made otherwise as described above receive a final outer surface coating of a metallic stearate dispersion, preferably zinc stearate.

Products for Second Fining of Lenses

The necessary and preferred specifications for these products have been given above.

We claim:

1. A coated abrasive sheet material suited for the second fining of lenses, said coated abrasive sheet material including a backing having on one major surface thereof a coating with an outer surface roughness of from 1.2 to 6 microns arithmetic average, said coating being the cured product of a slurry of adhesive and abrasive comprising:

(a) an adhesive component comprising, in percentages of the total acrylate content of said adhesive component, (i) from 100% to 36% by weight of triacrylated monomers, (ii) from 0–46% by weight of diacrylated monomers, and (iii) from 0–33% by weight of acrylated oligomers; and (b) white aluminum oxide abrasive grain having at least 70 volume percent of its particles with sedimentation characteristics equivalent to those of spherical particles with diameters of from 7 to 20 microns and an average particle size of from 10 to 14 microns, said abrasive grain being present in the slurry in a weight ratio to the adhesive component of from 1.0 to 2.5.

2. A coated abrasive according to claim 1, wherein the adhesive component additionally comprises a photoinitiator in sufficient quantity to cause cure of the adhesive/abrasive slurry upon exposure to UV light, and the cure of the product is initiated by exposure to such UV light.

3. A coated abrasive according to claim 2, wherein said slurry additionally comprises at least 0.002% by weight of an organotitanate or organosilane for promoting adhesion to the grain after cure.

4. A coated abrasive according to claim 2, wherein said slurry additionally comprises a material having non-acrylic vinyl unsaturation and having a lower viscosity than any of the acrylic components of said slurry.

5. A coated abrasive according to claim 4, wherein said backing is a polyethyleneterephthalate film and said percentage of triacrylated monomer is from 70% to 38%.

6. A coated abrasive according to claim 4, wherein said backing is waterproof paper and said percentage of triacrylated monomer is from 70% to 38%.

7. A coated abrasive suitable for use as a lapping material, said coated abrasive comprising:

(a) a backing; and (b) an abrasive coating adhered to said backing, said abrasive coating being formed by coating a suspension comprising lapping size abrasive grains, and a binder including at least one diacrylated monomer and at least one triacrylated or higher acrylated monomer and at least one acrylated oligomer onto said backing, and curing said binder by free-radical polymerization.

8. The coated abrasive of claim 7 wherein said abrasive grains have a median size of between about 11 and about 30 micrometers.

9. The coated abrasive of claim 8 wherein each diacrylated, and triacrylated or higher acrylated monomer has at least two substituted or unsubstituted acrylate groups.

10. The coated abrasive of claim 9 wherein said monomers are selected from the group consisting of urethane acrylates, urethane methacrylates, epoxy acrylates, and epoxy methacrylates.

11. A coated abrasive according to claim 8, wherein said binder further includes an adhesion promoter.

12. The coated abrasive of claim 11 wherein said adhesion promoter is an organosilane containing at least one organic group with 10–20 carbon atoms.

13. The coated abrasive of claim 7 wherein said curable binder includes a viscosity reducer.

14. The coated abrasive of claim 13 wherein said viscosity reducer is selected from the group consisting of hexane diol diacrylate, pentaerythritol triacrylate, and trimethylolpropane triacrylate.

15. The coated abrasive of claim 11 wherein said binder is curable by means of UV radiation.

16. The coated abrasive according to claim 7 wherein the acrylated oligomers are selected from the group consisting of: (i) diacrylates of epoxy resins of the bisphenol-A type, (ii) diacrylates of novolak phenolic resins, (iii) diacrylates of ester-linked urethane oligomers, (iv) triacrylates and higher acrylates of novolak phenolic resins, or (v) mixtures of the above oligomers.

17. The coated abrasive of claim 7 wherein the binder includes (a) from 21 to 27 percent by weight of diacrylated oligomers; (b) from 24 to 30 percent by weight of triacrylated monomers; (c) from 24 to 30 percent by weight of diacrylated monomers; and (d) from 15 to 20 percent by weight of an adduct of an amine with an acrylated monomer or oligomer.

18. The coated abrasive sheet of claim 17 wherein the amine is a primary, secondary, tertiary, or octyl amine.

19. The coated abrasive sheet of claim 17 wherein the amine is N-vinyl pyrrolidone.

20. Method of preparing a coated abrasive comprising the steps of:

(a) providing a coatable composition comprising a binder including a diacrylated monomer, a triacrylated or higher acrylated monomer, and an acrylated oligomer curable by free-radical polymerization and having lapping size abrasive grains suspended therein, (b) coating said coatable composition on a backing, and (c) curing said composition by means of free-radical polymerization.

21. The method of claim 20 wherein said composition is cured by means of actinic radiation.

22. The method of claim 20 wherein said composition is cured by means of thermal energy.

23. The method of claim 20 wherein said composition comprises a monomer having at least two ethylenically unsaturated moieties.

24. The method of claim 20 wherein said composition includes a viscosity reducer.

25. The method of claim 20 wherein said composition comprises a photoinitiator and is cured by means of UV or thermal and UV radiation.

26. Method of preparing a coated abrasive comprising the steps of:

(a) providing a coatable composition comprising a binder curable by UV or thermal and UV free-radical polymerization having lapping size abrasive grains suspended therein, (b) coating said coatable composition on a backing, and (c) curing said composition by means of UV or thermal and UV free-radical polymerization, wherein said composition includes an adhesion promoter.

27. The coated abrasive of claim 7 wherein said binder comprises a photoinitiator and is curable by means of UV or thermal and UV radiation.

28. The method of claim 26 wherein said composition is cured by means of UV radiation.

29. A coated abrasive sheet material comprising a flexible web backing, abrasive grain dispersed over at least one major surface of the backing, and a making adhesive layer between said surface and said abrasive grain, cured by free-radical polymerization and attaching the abrasive grain to the backing, the making adhesive layer comprising at least one acrylated monomer, at least one triacrylated or higher acrylated monomer, and at least one acrylated oligomer.

30. The coated abrasive sheet material of claim 29 wherein the making adhesive layer comprises (a) from 30 to 37 percent by weight of (i) amine adducts of triacrylated monomers, (ii) polycoesters of (I) iso-phthalic acid, (II) a linear vinylically unsaturated dicarboxylic acid or its anhydride, and (III) a diol, (iii) thermoplastic polymers, (iv) plasticizers, or (v) mixtures thereof; (b) from 29 to 33 percent by weight of triacrylated monomers, higher acrylated monomers, or mixtures thereof; and (c) from 25 to 35 percent by weight of diacrylated monomers, N-vinyl pyrrolidone, or mixtures thereof.

31. The coated abrasive sheet material of claim 29 wherein a sizing adhesive layer overlies the making adhesive layer, and the making adhesive layer comprises at least one diacrylated monomer, at least one triacrylated or higher acrylated monomer, and at least one acrylated oligomer.

32. The coated abrasive sheet material of claim 31 wherein the sizing adhesive layer comprises (a) from 22 to 28 percent by weight of a diacrylated oligomer; (b) from 6 to 39 percent by weight of triacrylated oligomer; (c) from 8 to 38 percent by weight of higher acrylated monomers; (d) from 5 to 10 percent by weight of diacrylated monomers; and (e) from 10 to 20 percent by weight of N-vinyl pyrrolidone, plasticizers, or mixtures thereof.

33. The coated abrasive sheet material of claim 29 wherein the making adhesive layer further including a photoinitiator and is cured by UV or thermal and UV free-radical polymerization.

* * * * *

US005527368C1

(12) REEXAMINATION CERTIFICATE (4342nd)

United States Patent

Supkis et al.

(10) Number: US 5,527,368 C1

(45) Certificate Issued: May 8, 2001

(54) COATED ABRASIVES WITH RAPIDLY CURABLE ADHESIVES

(75) Inventors: Stanley J. Supkis, Sand Lake; Eugene Zador, Clifton Park; Sitaramaiah Ravipati, Colonie; Richard A. Romano, Watervliet, all of NY (US); Walter A. Yarbrough, Stormstown, PA (US)

(73) Assignee: Norton Company, Worcester, MA (US)

Reexamination Request:
No. 90/005,515, Oct. 12, 1999

Reexamination Certificate for:

| | |
|---|---|
| Patent No.: | **5,527,368** |
| Issued: | **Jun. 18, 1996** |
| Appl. No.: | **07/355,229** |
| Filed: | **May 17, 1989** |

Related U.S. Application Data

(63) Continuation of application No. 06/735,029, filed on May 17, 1985, now abandoned, which is a continuation-in-part of application No. 06/680,619, filed on Dec. 9, 1984, now abandoned, which is a continuation-in-part of application No. 06/473,377, filed on Mar. 11, 1983, now abandoned.

(51) Int. Cl.[7] ..... B24D 3/02

(52) U.S. Cl. ..... 51/298; 51/295

(58) Field of Search ..... 51/295, 298

(56) References Cited

U.S. PATENT DOCUMENTS

| | | | |
|---|---|---|---|
| 3,041,156 | 6/1962 | Rowse et al. | 51/298 |
| 3,489,541 | 1/1970 | Steinberg | 51/295 |
| 3,498,827 | 3/1970 | Vanderbilt et al. | 117/75 |
| 3,804,607 | 4/1974 | Jungell | 51/298 |
| 4,457,766 | 7/1984 | Caul | 51/298 |

FOREIGN PATENT DOCUMENTS

| | | | |
|---|---|---|---|
| 0 057 392 | 8/1982 | (EP) | B24D/3/32 |
| 2 087 263 | 5/1982 | (GB) | B32B/5/16 |
| 52-65391 | 5/1977 | (JP) | B24D/3/28 |

OTHER PUBLICATIONS

Union Carbide product literature, "Silane Adhesion Promoters in Mineral–Filled Composites" (1973), pp. 6–37 (no month).

Meyer R. Rosen, "The Life History of a Silane Coupling Agent", *Journal of Coatings Technology,* (1978), pp. 70–82 (no month).

Edwin P. Plueddemann, "Silane Coupling Agents", (1982), pp. 167–205 (no month).

*Primary Examiner*—Michael Marcheschi

(57) ABSTRACT

A coated abrasive having improved properties of grinding performance and brittleness, said abrasive comprising a backing and an abrasive coating adhered thereon wherein the abrasive coating comprises a suspension containing lapping size abrasive grains and a binder, said binder containing a diacrylated monomer and a triacrylated or higher acrylated monomer.

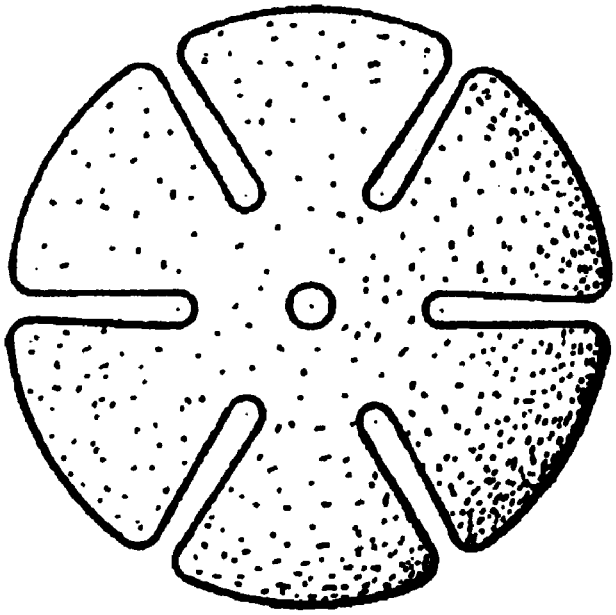

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–33 is confirmed.

* * * * *